US007219818B2

(12) United States Patent
Pan

(10) Patent No.: US 7,219,818 B2
(45) Date of Patent: May 22, 2007

(54) CONTROLLED DISPENSING DEVICE

(76) Inventor: Shun-I Pan, 6023 N. Walnut Grove Ave., San Gabriel, CA (US) 91775

( * ) Notice: Subject to any disclaimer, the term of this patent is extended or adjusted under 35 U.S.C. 154(b) by 269 days.

(21) Appl. No.: 11/081,307

(22) Filed: Mar. 15, 2005

(65) Prior Publication Data

US 2006/0208006 A1 Sep. 21, 2006

(51) Int. Cl.
*B67D 3/00* (2006.01)

(52) U.S. Cl. ..... 222/478; 141/127; 222/134

(58) Field of Classification Search ..... 222/478, 222/481, 132, 133, 134, 156, 402.25, 402.23, 222/464.2, 497, 482, 485, 591, 522, 71–74, 222/129.4, 282, 283, 310; 141/127, 134, 141/90, 91

See application file for complete search history.

(56) References Cited

U.S. PATENT DOCUMENTS 2,765,962 A * 10/1956 Perkins ..... 222/255
3,072,303 A * 1/1963 Monk ..... 222/485
3,442,304 A * 5/1969 Theys et al. ..... 141/134
4,366,918 A * 1/1983 Naka ..... 222/134
4,602,657 A * 7/1986 Anderson et al. ..... 137/595
4,979,639 A * 12/1990 Hoover et al. ..... 222/1
7,069,963 B2 * 7/2006 Friberg et al. ..... 141/2
7,108,024 B2 * 9/2006 Navarro ..... 141/127

* cited by examiner

*Primary Examiner*—Lien M. Ngo
(74) *Attorney, Agent, or Firm*—Joe Nieh

(57) ABSTRACT

A dispensing device that can economically and reliably dispenses predetermined quantity of fluids accurately comprising an elongated rod with one or more through holes formed perpendicularly through its axis defining one or more fluid flow paths. Adjacent to each through hole is an angular fluid flow path with one section generally parallel to the through hole and another section generally perpendicular to the through hole. In the preferred embodiment, the through holes and the angular fluid flow paths are positioned alternately through most of the length of the elongated rod. The elongated rod slides within a base component that has corresponding openings to enable accurate and reliable dispensing of predetermined quantity of fluids through the controlled dispensing device.

6 Claims, 3 Drawing Sheets

Detail C

Detail D

SECTION A-A

SECTION B-B

CONTROLLED DISPENSING DEVICE

BACKGROUND

1. Field of Invention

The present invention relates generally to a metering device to control the dispensing of fluids. More specifically, the present invention relates to a dispensing device that economically and reliably dispenses predetermined quantity of fluids accurately.

2. Description of Related Art

In many manufacturing processes, a predetermined quantity of fluid must be accurately transferred from bulk storage into small containers. For mass production, this transferring and dispensing of fluid must be performed quickly, economically, reliably, and accurately.

One of the commonly used dispensing device is a very precise electrical valve that accurately releases a predetermined quantity of fluids under pressure from a bulk container. Fluids are fed from a bulk container under pressure to an electrical valve. The electrical valve opens for a short moment to release a predetermined amount of fluid. The main control is the very expensive electrical valve. The electrical valve is expensive to maintain and replace. Furthermore, the electrical valve has a relatively short operating life.

BRIEF SUMMARY OF THE INVENTION

An objective of the present invention is to provide an economical and reliably dispensing device that can accurately dispense fluid from a source to a destination. A further objective of the present invention is to provide a mechanical means for accurately dispensing fluid for mass production process. Yet another objective of the present invention is to provide a low maintenance controlled dispensing device that can reliably and accurately dispense a predetermine quantity of fluid.

The present invention is a dispensing device that can economically and reliably dispenses predetermined quantity of fluids accurately. The controlled dispensing device comprises of an elongated rod with one or more through holes formed perpendicularly through its axis defining one or more fluid flow paths. Adjacent to each through hole is an angular fluid flow path with one section generally parallel to the through hole and another section generally perpendicular to the through hole. In the preferred embodiment, the through holes and the angular fluid flow paths are positioned alternately through most of the length of the elongated rod. The elongated rod slides within a base component that has corresponding openings to enable accurate and reliable dispensing of predetermined quantity of fluids through the controlled dispensing device.

DETAILED DESCRIPTION OF THE PREFERRED EMBODIMENT

The following description and figures are meant to be illustrative only and not limiting. Other embodiments of this invention will be apparent to those of ordinary skill in the art in view of this description.

Figure 1:
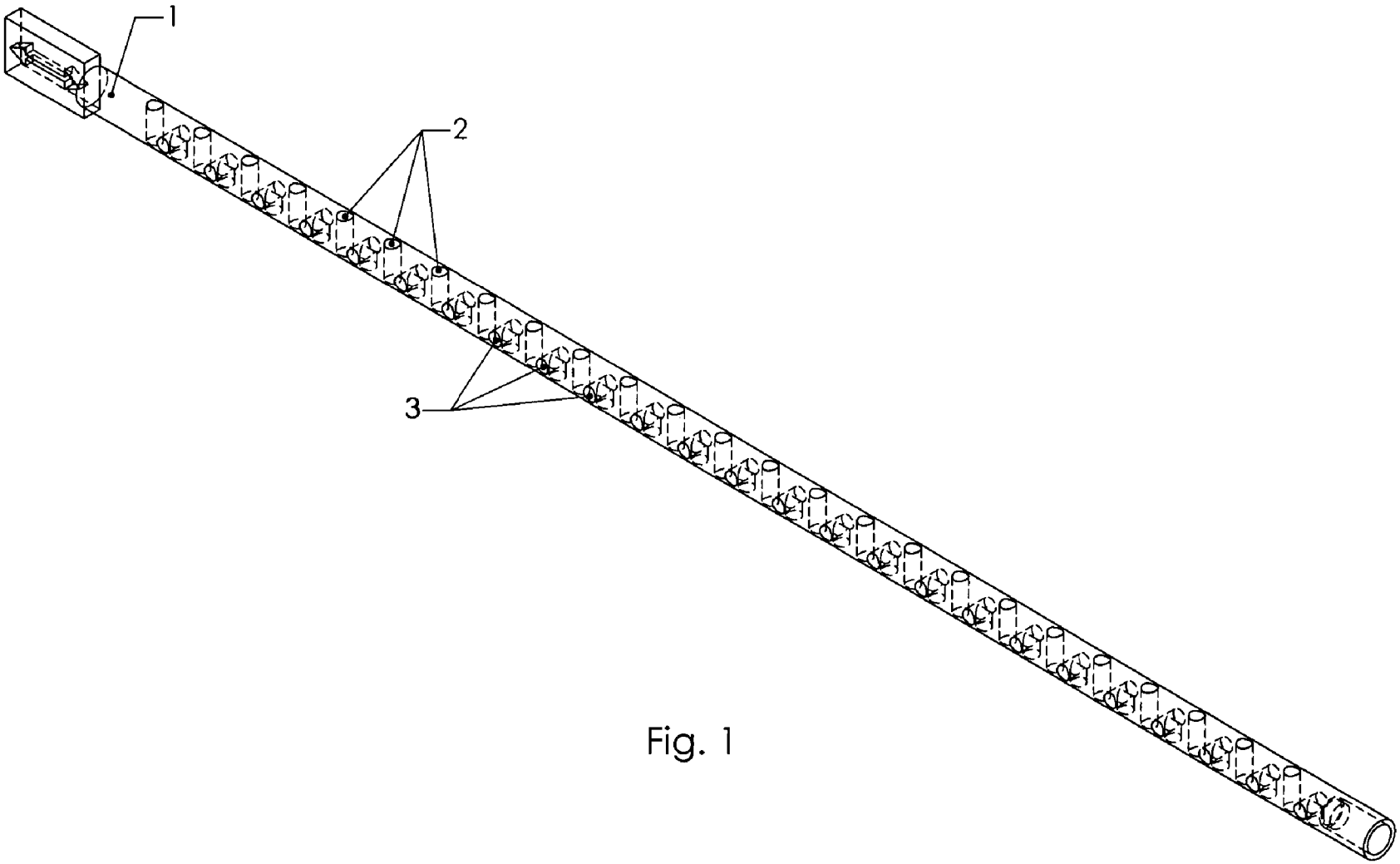
FIG. 1 shows the preferred embodiment of elongated solid rod in the controlled dispensing device.
Figure 2:
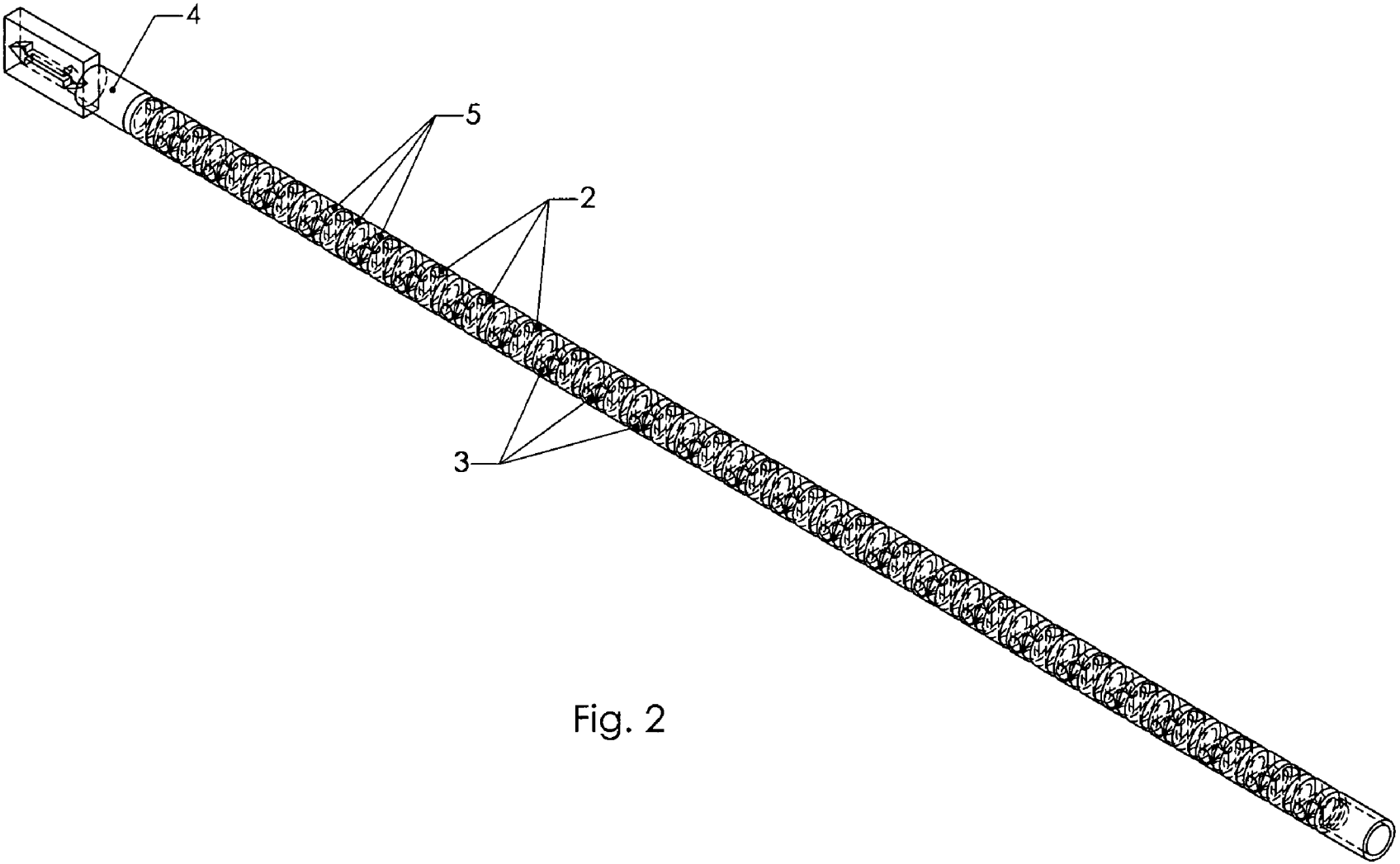
FIG. 2 shows an alternative embodiment of the elongated solid rod in the controlled dispensing device.

FIG. 1 shows the preferred embodiment of the controlled dispensing device. In the preferred embodiment, the controlled dispensing device comprises of an elongated solid rod 1 with multiple through holes 2 formed at regular intervals perpendicularly through its longitudinal axis defining one or more fluid flow paths through the elongated solid rod 1. Adjacent to each through hole 2 is an angular fluid flow path 3 with half of the angular flow path generally parallel to the through hole 2 and the other half of the angular fluid flow path 3 generally perpendicular to the through hole 2. The two halves of the angular flow path 3 are in fluid connection generally at the longitudinal axis of the elongated solid rod 1. In the preferred embodiment, the multiple through holes 2 and the angular fluid flow paths 3 are positioned alternately through most of the length of the elongated solid rod 1. In an alternate embodiment, as shown in FIG. 2, the elongated solid rod 4 has a circular groove 5 between each of the through hole 2 and the adjacent angular fluid flow path 3. An O-ring is disposed in each of the circular groove 5 to provide sealing.

Figure 3:
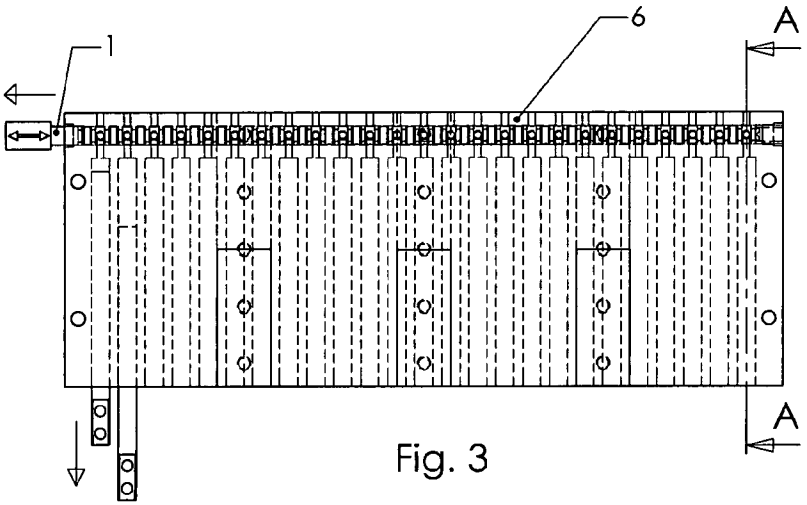
FIG. 3 shows the preferred embodiment of the controlled dispensing device in the first position.
Figure 6:
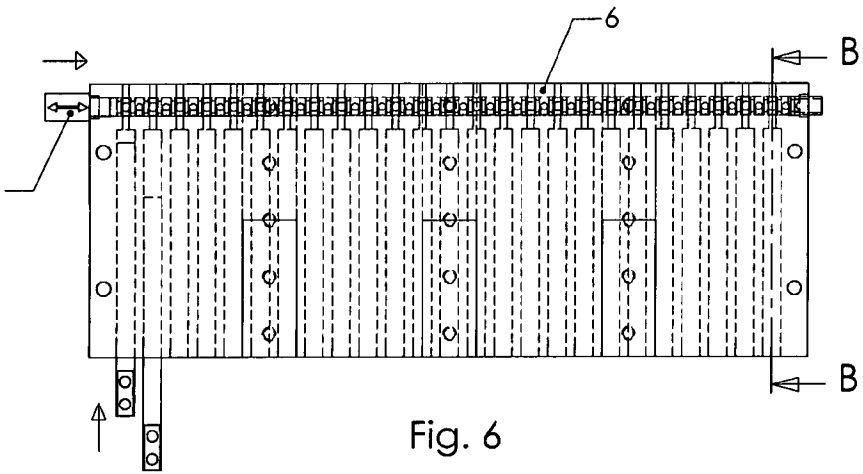
FIG. 6 shows the preferred embodiment of the controlled dispensing device in the second position.

As shown in FIGS. 3 and 6, the elongated solid rod 1 is slidably disposed in a base component 6 with three corresponding openings 7, 8, 9 that correspond with the two open ends of the through hole 2 and the angular fluid flow path opening that is perpendicular to the through hole 2. The three openings 7, 8, 9 are all positioned on the same plane perpendicular to the axis of the elongated solid rod 1. As the elongated solid rod 1 slides within the base component 6, one of the openings will be blocked by the elongated solid rod 1.

Figure 5:
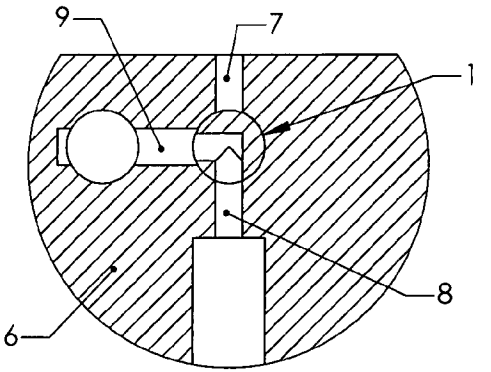
FIG. 5 shows an enlarged cross-sectional side-view of the preferred embodiment of the controlled dispensing device in the first position.
Figure 4:
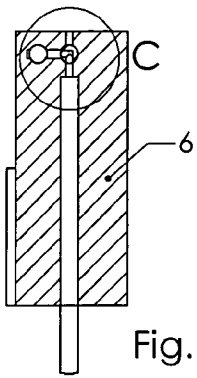
FIG. 4 shows a cross-sectional side-view of the preferred embodiment of the controlled dispensing device in the first position.

As shown in FIGS. 3, 4, and 5, in a first position, one of the opening 7 that corresponds with one open end of the through hole 2 is blocked, leaving the other opening at the other open end of the through hole 2 in fluid connection with the remaining opening 8 in the base component 6 that corresponds with the other open end of the through hole 2. In this first position, the angular fluid flow path 3 that is perpendicular to the through hole 2 will also be in fluid connection with the corresponding opening 9 in the base component 6.

Figure 8:
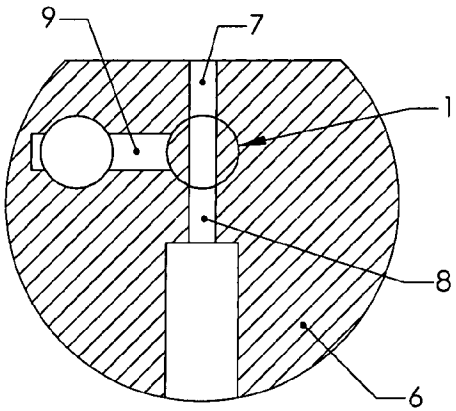
FIG. 8 shows an enlarged cross-sectional side-view of the preferred embodiment of the controlled dispensing device in the second position.
Figure 7:
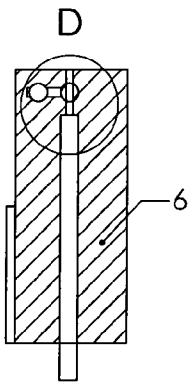
FIG. 7 shows a cross-sectional side-view of the preferred embodiment of the controlled dispensing device in the second position.

A pump may be utilized to withdraw fluids from its source, such as a bulk container, through the angular fluid flow path 3. After a predetermined quantity of fluid is withdrawn, the elongated solid rod 1 is slid to its second position wherein the two openings 7, 8 in the base component 6 that correspond with the two open ends of the through hole 2 are in fluid connection as shown in FIGS. 6, 7, and 8. In this second position, the angular fluid flow path 3 that is perpendicular to the through hole 2 will be blocked by the base component 6. The pump is then utilized to eject the withdrawn fluids through the through hole 2 and the openings in the base component 6 into the desired container. Alternatively, the pump may withdraw fluids through the through holes 2 and eject the withdrawn fluid through the angular fluid flow paths 3.

Another embodiment of the present invention utilizes a circular solid rod that slides in a circular channel in a base component. The circular solid rod has multiple through holes formed at regular intervals perpendicularly through its circular axis defining one or more fluid flow paths through the circular solid rod. Adjacent to each hole is an angular fluid flow path with half of the angular flow path generally parallel to the through hole and the other half of the angular fluid flow path generally perpendicular to the through hole. The two halves of the angular flow path are in fluid connection generally at the circular axis of the circular solid rod. The multiple through holes and the angular fluid flow paths are positioned alternately through the circumference of the circular solid rod. The circular solid rod may also have a circular groove between each of the through hole and the adjacent angular fluid flow path so that an O-ring may be disposed in each of the circular groove to provide sealing.

The circular solid rod is slidably disposed in a base component with two corresponding openings that correspond with the an open end of the through hole and the fluid flow path opening that is perpendicular to the through hole. The two openings are all positioned on the same plane perpendicular to the circular axis of the circular solid rod. As the circular solid rod is rotated within the channel in the base component, one of the openings will be blocked by the circular solid rod. A pump may be utilized to operate this alternate embodiment with the circular solid rod in a similar fashion to the elongated solid rod embodiment to reliably and accurately dispense a predetermine quantity of fluid.

The controlled dispensing device replaces the conventional expensive electrical valve with a mechanical device that is low cost, reliable, and meters an accurate quantity of fluids for mass production process. The controlled dispensing device of the present invention may be economically utilized for mass production to fill liquid filled cotton swabs or other similar small containers of fluids.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A controlled dispensing device comprising:

an elongated rod with multiple through holes formed generally perpendicularly through its longitudinal axis defining one or more fluid flow paths through the elongated rod and adjacent to each said through hole is an angular fluid flow path with half of said angular flow path generally parallel to said through hole and the other half of said angular fluid flow path generally perpendicular to said through hole; and a base component with three corresponding openings that correspond with two open ends of each of said through hole and said angular fluid flow path opening that is perpendicular to said through hole with all three openings positioned on the same plane perpendicular to the axis of said elongated rod;

wherein said elongated rod is slidably disposed within said base component.

2. A controlled dispensing devices as in claim 1, wherein said multiple through holes and said angular fluid flow paths are positioned alternately in regular intervals through most of the length of said elongated rod.

3. A controlled dispensing devices as in claim 1, wherein said elongated rod has a circular groove between each of said through hole and said adjacent angular fluid flow path and an O-ring disposed in each of said circular groove.

4. A controlled dispensing device comprising:

a circular rod with a circular axis and comprising multiple through holes perpendicular to said circular axis defining one or more fluid flow paths through said circular rod and adjacent to each through hole is an angular fluid flow path with half of said angular flow path generally parallel to said through hole and the other half of said angular fluid flow path generally perpendicular to said through hole; and a base component with a circular groove with two openings that correspond with an open end of said through hole and an fluid flow path opening that is perpendicular to said through hole with said two openings positioned on the same plane perpendicular to said circular axis of said circular rod;

wherein said circular rod is slidably disposed in said circular groove in said base component.

5. A controlled dispensing devices as in claim 4, wherein said multiple through holes and said angular fluid flow paths are positioned alternately in regular intervals through most of the circumference of said circular rod.

6. A controlled dispensing devices as in claim 4, wherein said circular rod has a circular groove between each of said through hole and said adjacent angular fluid flow path and an O-ring disposed in each of said circular groove.

* * * * *